United States Patent [19]

Bigelow

[11] 3,930,867

[45] Jan. 6, 1976

[54] MACROCYCLIC POLYAMINES AS SENSITIZERS FOR SILVER HALIDE EMULSIONS

[75] Inventor: John H. Bigelow, Rochester, N.Y.

[73] Assignee: E. I. Du Pont de Nemours and Company, Wilmington, Del.

[22] Filed: Jan. 7, 1974

[21] Appl. No.: 431,302

[52] U.S. Cl. ..... 96/107; 96/108

[51] Int. Cl.[2] ..... G03C 1/28

[58] Field of Search ..... 96/107, 108

[56] References Cited

UNITED STATES PATENTS

| | | | |
|---|---|---|---|
| 2,743,182 | 4/1956 | Lowe et al. | 96/107 |
| 3,408,196 | 10/1968 | McVeigh | 96/108 |
| 3,595,662 | 7/1971 | Willems et al. | 96/107 |

*Primary Examiner*—Won H. Louie, Jr.

[57] ABSTRACT

Photographic silver halide emulsions are prepared which have their sensitivity increased by the addition of at least one macrocyclic polyamine, a salt, or a metal chelate thereof, said macrocyclic polyamine having the formula $$\left[(NH-(CH_2)_n)_m\right]$$

where $m$ is 4–7 and each $n$ is independently 2–5.

21 Claims, No Drawings

MACROCYCLIC POLYAMINES AS SENSITIZERS FOR SILVER HALIDE EMULSIONS

BACKGROUND OF THE INVENTION

1. Field of the Invention

This invention relates to chemically sensitized photographic silver halide emulsions and to photographic elements comprising a support having a light-sensitive layer coated from said emulsions. One aspect of this invention relates to sensitizing negative-working silver halide emulsions with at least one macrocyclic polyamine or a chelate with a metal taken from the group consisting of iron, nickel, copper, rhodium and thallium. Another aspect of this invention relates to sensitizing a direct positive, silver halide emulsion with at least one macrocyclic polyamine or metal chelate thereof. The photographic emulsion sensitization according to this invention is generally applicable to negative-working and positive-working silver halide developing out emulsions.

2. Description of the Prior Art

Chemical sensitizers, as distinguished from optical sensitizers, are frequently used to enhance the sensitivity of silver halide emulsions. Compounds known to be useful as chemical sensitizers include, for example, the polyoxyalkylene compounds, sulfur compounds, and salts of noble metals, e.g., gold, platinum, etc.

This invention relates to adding macrocyclic polyamines to silver halide emulsions as chemical sensitizers. Many macrocyclic amines of the invention are known. These compounds and methods of preparing them and their salts and metal chelates are described in the following prior art and literature references, which are incorporated herein by reference: N. F. Curtis, Coord. chem. Rev. 3, 3 (1968), D. C. Olson and J. Vasilevskis, Inorg. Chem. 8, 1611 (1969), L. G. Warnes et al, J. Am. Chem. Soc., 90:25, 6938 (1968), N. F. Curtis et al, J. Chem. Soc., 1015 (1966), L. G. Warner and D. H. Busch, J. Am. Chem. Soc., 91:15, 4092 (1969), M. M. Blight and N. F. Curtis, J. Chem. Soc. 3, 3016 (1962), D. C. Olson and J. Vasilevskis, Inorg. Chem. 10, 463 (1971), N. F. Curtis, J. Chem. Soc., 2644 (1964), M. O. Kestner and A. L. Allred, J. Am. Chem. Soc., 94:20, 7189 (1972), B. Bosnick et al, Inorg. Chem. 4, 1102 (1965), G. A. Kalligeros and E. L. Bluin, Inorg. Chem. 11, 1145 (1972), H. Stetter and K. H. Mayer, Chem. Ber., 94, 1410 (1961), J. P. Collman and P. W. Schneider, Inorg. Chem., 5, 1380 (1966); and U.S. patent application Docket No. CR-7505, filed Oct. 4, 1973 by J. E. Richman. While preparation of macrocyclic amines is described in these references, silver halide emulsions containing these compounds have not been known.

SUMMARY OF THE INVENTION

The subject of this invention is a colloid-silver halide emulsion of the developing out type sensitized by adding a sensitizing amount of a macrocyclic polyamine or a salt or metal chelate thereof.

The macrocyclic polyamines of the invention have the formula:

$$\left[ (NH - (CH_2)_n)_m \right]$$

where $m$ is 4–7 and each $n$ is independently 2–5. Also included are the salts of the above amines and chelates with metals of groups I*b*, III*a*, and VIII of the Periodic Table, in particular complexes of the aforesaid polyamines with iron, nickel, copper, rhodium or thallium.

DESCRIPTION OF THE PREFERRED EMBODIMENTS

The macrocyclic polyamines and their metal chelates may be used to sensitize a wide variety of negative-working and positive-working, developing out, silver halide emulsions including radiographic emulsions, seismographic emulsions, paper emulsions including variable contrast elements, and graphic arts emulsions such as those used in lithographic films and direct positive reversal films to name a few.

The method of adding the novel macrocyclic polyamine sensitizers is not critical and they may be added during or after the precipitation of silver halides, during Ostwald ripening during the digestion period, or as a final addition before coating. The concentration of the novel sensitizers is not critical and may be varied over a wide range depending upon the intended purpose. Good sensitization is usually achieved when the macrocyclic polyamine compounds are added in quantities of from $3 \times 10^{-9}$ gram to 0.3 gram per 1.5 moles of the silver nitrate used to precipitate the silver halide. It will be found, of course, that certain of the polyamine compounds are more effective than others when used in equivalent amounts and the proper quantity to be used will depend upon the particular macrocyclic polyamine or metal chelate or acid salt thereof, the type of emulsion and the degree of sensitization desired.

Among the macrocyclic polyamines, metal chelates or acid salts thereof as defined above, the following have been found to be particularly useful.

TABLE I

MACROCYCLIC POLYAMINES, SALTS, AND METAL CHELATES

| Compound | Structural Formula | Name |
|---|---|---|
| I | 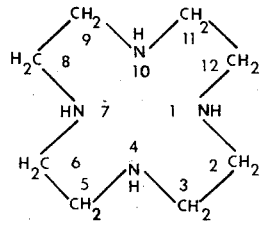 | "cyclen", or 1,4,7,10-tetra-azacyclo-dodecane |

TABLE I-continued
| Compound | MACROCYCLIC POLYAMINES, SALTS, AND METAL CHELATES Structural Formula | Name |
|---|---|---|
| II | 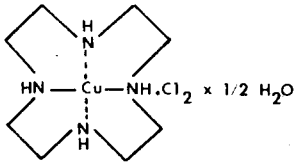  | copper″ chloride cyclen chelate |
| III | 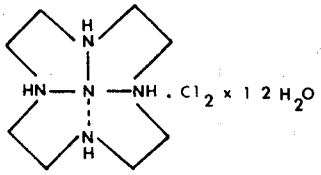  | Nickel″ chloride cyclen chelate |
| IV | 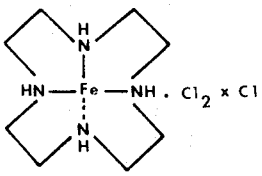  | Iron‴ chloride cyclen chelate |
| V | 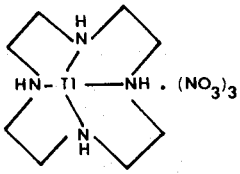  | Thallium‴ nitrate cyclen chelate |
| VI | 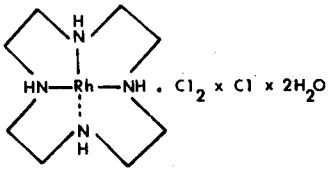  | Rhodium‴ chloride cyclen chelate |
| VII | 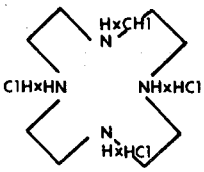  | Cyclen tetra-hydro-chloride |
| VIII | 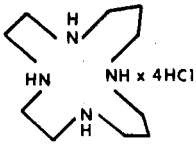  | "isocyclam" tetra-hydro-chloride |

TABLE I-continued

| MACROCYCLIC POLYAMINES, SALTS, AND METAL CHELATES | | |
|---|---|---|
| Compound | Structural Formula | Name |
| IX | 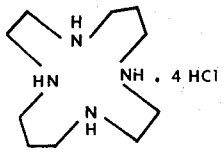 | "cyclam" 1,4,8,11-tetraaza-cyclotetra-decane tetra-hydro-chloride |
| X | 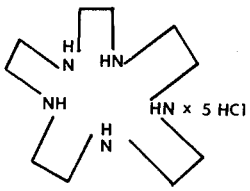 | 1,4,7,10,13-penta aza-cyclopenta decane penta-hydro-chloride |
| XI | 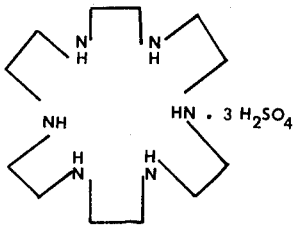 | 1,4,7,10, 16-hexa-azacyclo octadecane trisulfuric acid |
| XII | 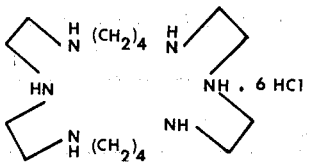 | 1,4,9,12,15, 20-hexaaza-cyclodocosane hexahydro-chloride |
| XIII | 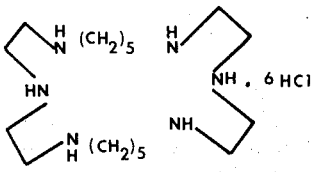 | 1,4,7,13,16 19-hexaaza-cyclotetracosane hexahydrochloride |
| XIV | 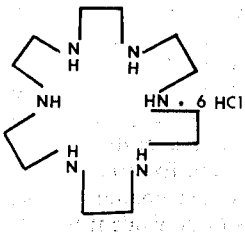 | 1,4,7,10,13, 16-hexaaza-cycloocta-decane hexa-hydrochloride |

TABLE I-continued

| Compound | MACROCYCLIC POLYAMINES, SALTS, AND METAL CHELATES Structural Formula | Name |
|---|---|---|
| XV | 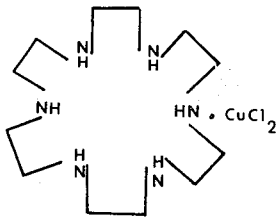 | 1,4,7,10,13,16-hexaazacyclooctadecane copper chloride chelate |
| XVI | 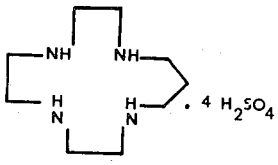 | 1,4,7,10-tetraazacyclotridecane tetradihydrosulfate |
| XVII | 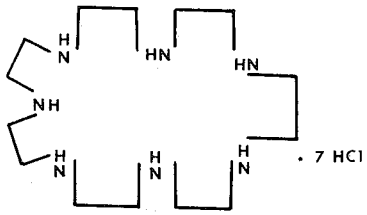 | 1,4,7,10,13,16,19 heptaazacyclohenesane heptahydrochloride |

EXAMPLE I

Five high-speed negative-working gelatino-silver iodobromide emulsions containing 1.6 mole % silver iodide and 98.4% mole % silver bromide were made by rapidly pouring a solution containing 1.5 mole of silver nitrate and 3 moles of ammonia into gelatin solutions containing 1.5 moles of an appropriate mixture of potassium bromide and potassium iodide and 0.03 gram of each of the compounds number I–IV above. The fifth emulsion was used as a control. The emulsions were ripened for 5 minutes at 135°F. and then they were neutralized with acetic acid. The resulting emulsions were colled, coagulated, washed, and redispersed in the manner disclosed in Moede, U.S. Pat. No. 2,772,162 issued Nov. 27, 1956.

Bulking gelatin was added to the emulsions and the temperature raised to 110°F. The pH was adjusted to 6.5 and the emulsions were heated to 125°F. Conventional gold and sulfur sensitizers were added to the emulsions and they were then digested for 60 minutes at 125°F. The pH of the emulsions was adjusted to 5.5, coating aids, including gelatin hardeners, were added and the resulting emulsions were coated on a suitable photographic film support and dried in a conventional manner as is practiced in the art.

Strips of the coated emulsions were exposed through a $\sqrt{2}$ step wedge at $10^{-6}$ seconds in an Edgerton, Germeshausen and Greer flash tube sensitometer Mark VII which is equivalent to 29 meter-candle-seconds and developed for 1½ minutes at 80°F. in a commercial hydroquinone-formaldehyde developer, immersed in a short stop bath and fixed in a conventional fixing solution. The strips were washed and dried and densities were read on a conventional densitometer. The results are shown in the following table.

TABLE II

| Coating No. | Compound Added | Fog | $D_{max}$ | Speed (Dens. = 1.0) |
|---|---|---|---|---|
| 1 | I | .02 | 2.21 | 200 |
| 2 | II | .02 | 1.97 | 132 |
| 3 | III | .02 | 2.32 | 200 |
| 4 | IV | .07 | 2.92 | 400 |
| 5 | Control-None | .02 | 1.98 | 100 |

The data show that the macrocyclic polyamine, 1,4,7,10-tetraazacyclododecane and its copper, nickel and iron chelates act as sensitizers in a silver iodobromide emulsion system.

EXAMPLE II

Gelatino-silver iodobromide emulsions were prepared as described in Example I except that to the four gelatin solutions containing potassium bromide and potassium iodide there was added per 1.5 moles of silver nitrate $1.83 \times 10^{-4}$ mole quantities of compound I above, rhodium chloride, compound VI above and rhodium chloride plus compound I respectively. All other conditions of digestion, coating and drying were the same as in Example I.

Strips of the coated emulsions were exposed in a sensitometer equivalent to 4470 meter-candle-seconds and developed in 2 minutes at 68°F in a conventional metol-hydroquinone developer and fixed, washed and dried. Sensitometric data are shown in the following table.

TABLE III

| Coating No. | Additive | Fog | $D_{max}$ | Speed (D = 1.0) | Gamma (D = 0.5 to 1.5) |
|---|---|---|---|---|---|
| 1 | Control-None | .03 | 2.08 | 100 | 1.85 |
| 2 | Compound I | .03 | 2.48 | 165 | 1.96 |
| 3 | Rhodium Chloride | .03 | 21 | — | — |
| 4 | Compound VI | .04 | 3.21 | 130 | 2.26 |
| 5 | Compound I + Rhodium Chloride | .02 | .67 | — | — |

The data indicate that 1,4,7,10-tetraazacyclododecane and its rhodium chelate are active sensitizers. Rhodium chloride alone causes desensitization of the emulsion, but 1,4,7,10-tetraazacyclododecane improves response even in the presence of rhodium chloride.

EXAMPLE III

Two emulsions were made as described in Example I. To the gelatin solutions of potassium bromide and potassium iodide used to form the silver halides of one emulsion there was added 0.3 gram per 1.5 moles of silver nitrate of compound VII above. The emulsions were otherwise handled as in Example I but exposed as described in Example II. The following sensitometric data show the sensitizing effect of compound VII:

TABLE IV

| Coating No. | Additive | Fog | $D_{max}$ | Speed (Dens.=10) | Gamma (Dens.=0.5 to 1.5) |
|---|---|---|---|---|---|
| 1 | None-Control | .03 | 3.36 | 100 | 2.33 |
| 2 | Compound VII | .04 | 3.11 | 142 | 3.85 |

EXAMPLE IV

Three emulsions were made as described in Example I. One emulsion was used as a control. A second emulsion contained 0.1 gram per 1.5 moles of silver nitrate of Compound IV introduced as a final addition just before coating, and a third emulsion contained 0.02 gram per 1.5 moles of silver nitrate of compound IV which had been added to the gelatin solution containing potassium bromide and potassium iodide just prior to precipitation of the silver halides. All other conditions of handling and testing were carried out as described in Example II. In addition strips were tested fresh and after oven aging of seven days at a temperature of 120°F. and a relative humidity of 62%. Sensitometric data are shown in the following table.

TABLE V

| Emulsion No. | Test Conditions | Fog | $D_{max}$ | Speed (Dens.=1.0) | Gamma (Dens.=0.5 to 1.5) |
|---|---|---|---|---|---|
| 1 (Control) | Fresh | .04 | 1.56 | 100 | 1.98 |
| | Oven | .03 | 1.26 | 90 | 1.39 |
| 2 (as a final addition) | Fresh | .03 | 2.00 | 172 | 2.04 |
| | Oven | .03 | 1.87 | 202 | 1.59 |
| 3 (added just prior to ppt.) | Fresh | .09 | 2.00 | 176 | 1.85 |
| | Oven | .09 | 1.51 | 125 | 1.45 |

The data indicate the iron chloride chelate of 1,4,7,10-tetraazacyclododecane acts as a sensitizer regardless of where it is added in the system, and maintains the effect under conditions of aging at high temperature and humidity.

EXAMPLE V

Silver chlorobromide emulsions were made in the following manner. To an acidified solution of gelatin containing 1.5 moles of potassium chloride there was rapidly added 1.5 moles of silver nitrate in aqueous solution. Except for one emulsion used as a control compounds III and IV were added to the potassium chloride solutions in the quantities shown in the table below. There was then added 0.6 moles of potassium bromide in aqueous solution, and the mixture was heated to 160°F and held for 10 minutes after which there was added an aqueous solution containing 0.9 mole of potassium bromide and the mixture was held at 160°F. for another 10 minutes. The resulting emulsion was cooled, coagulated, washed and redispersed in the manner disclosed in Moede, U.S. Pat. No. 2,772,162 issued Nov. 27, 1956.

Bulking gelatin was then added to each emulsion and the temperature was raised to 130°F. The pH was adjusted to 8 with borax and the emulsions were heated for 40 minutes at 130°F. The pH was adjusted to 5.5 with acetic acid, and coating aids and a gelatin hardener were added. The emulsions were coated on a photographic film base and dried in a conventional manner. Test strips of the emulsions were exposed through a $\sqrt{2}$ step wedge by means of a quartz-iodine lamp which provided an exposure of 514,000 meter-candle-seconds. The strips were processed as described in Example I and the densities read in a conventional densitometer. The results are shown in the following table.

TABLE VI

| Emulsion No. | Additive Variation per 1.5 moles of Silver Nitrate | Fog | Step 11 Density | $D_{max}$ |
|---|---|---|---|---|
| 1 | None - Control | .03 | .02 | .08 |
| 2 | 0.3 gram Compound III | .05 | .07 | 1.31 |
| 3 | 0.1 gram Compound III | .05 | .02 | .21 |
| 4 | 0.05 gram Compound III | .06 | .01 | .11 |
| 5 | 0.3 gram Compound IV | .07 | .13 | 2.22 |
| 6 | 0.1 gram Compound IV | .06 | .04 | .68 |
| 7 | 0.05 gram Compound IV | .06 | .03 | .26 |
| 8 | 0.025 gram Compound IV | .06 | .00 | .09 |

The data indicate that while both the nickel and iron chelates of 1,4,7,10-tetraazacyclododecane sensitize the gelatino-silver chlorobromide system, the iron chelate appears to be the stronger sensitizer because it produces greater response at equal concentration.

EXAMPLE VI

Example V was repeated except that 0.2 gram of compound I per 1.5 moles of silver nitrate was added to the aqueous potassium chloride solution of one emulsion and 0.2 gram per 1.5 moles of silver nitrate of Compound VII was added to the aqueous potassium chloride solution of another emulsion. The emulsions were otherwise treated as in Example V. The strips were exposed and processed as described in Example V to give the following sensitometric results.

TABLE VII

| Emulsion No. | Additive Variation per 1.5 moles of Silver Nitrate | Fog | Step 11 Density | $D_{max}$ |
|---|---|---|---|---|
| 1 | Control-None | .03 | .02 | .08 |
| 2 | 0.2 gram Compound I | .01 | .01 | .41 |
| 3 | 0.2 gram Compound VII | .05 | .02 | .15 |

The data indicate that both the free base and the tetrahydrochloride of 1,4,7,10-tetraazacyclododecane act as sensitizers.

EXAMPLE VII

The emulsion 3 of Example VI was prepared along with a control except that, upon redispersion, sulfur and gold sensitizers were added during digestion as described in Example I. Sample strips were exposed and processed as described in Example II. Sensitometric data are set forth in the following table.

TABLE VIII

| Emulsion No. | Additive | Fog | $D_{max}$ | Speed (Dens. 2.0) |
|---|---|---|---|---|
| 1 | None-Control | .09 | 2.96 | 100 |
| 2 | 0.2 gram Compound VII | .54 | 3.31 | 236 |

The data indicate that the tetrahydrochloride derivative of 1,4,7,10-tetraazacyclododecane in combination with gold and sulfur sensitizers is a very active sensitizer for gelatino-silver chlorobromide systems. The high fog as compared to the control merely indicates that the preferred amount has not been optimized.

EXAMPLE VIII

Example VII was repeated using 0.3 gram per 1.5 moles silver nitrate of Compound II listed above in the potassium chloride solution. The control and test emulsions were exposed and processed as described in Example I above. Sensitometric data are set forth in the following table.

TABLE IX

| Emulsion No. | Additive | Fog | $D_{max}$ |
|---|---|---|---|
| 1 | None-Control | .01 | .21 |
| 2 | 0.3 gram Compound II | .01 | .38 |

It is evident that Compound II is an active photographic sensitizer.

EXAMPLE IX

Example V was repeated using one emulsion as a control. To the other aqueous potassium chloride solutions for the precipitation of the silver chloride there was added per 1.5 moles silver nitrate the indicated quantities of Compounds XII, X, XI, and XIII listed above. All other conditions of coating, finishing, exposing and processing were carried out as in Example V to give the results shown in the following table. Results show that the compounds are active silver halide emulsion sensitizers.

TABLE X

| Emulsion No. | Additive Variation | Fog | $D_{max}$ |
|---|---|---|---|
| 1 | None-Control | .03 | .08 |
| 2 | .01 gram Compound XII | .03 | .79 |
| 3 | .05 gram Compound XII | .06 | 2.69 |
| 4 | .01 gram Compound X | .04 | .42 |
| 5 | .05 gram Compound X | .05 | 1.51 |
| 6 | .10 gram Compound X | .08 | 2.45 |
| 7 | .01 gram Compound XI | .04 | .23 |
| 8 | .05 gram Compound XI | .04 | 2.32 |
| 9 | .10 gram Compound XI | .04 | 2.50 |
| 10 | .01 gram Compound XIII | .04 | .75 |
| 11 | .05 gram Compound XIII | .09 | 1.63 |

EXAMPLE X

Example X was repeated using one emulsion as a control. To the other aqueous potassium chloride solutions used for the precipitation of the silver chloride there was added per 1.5 moles silver nitrate the indicated quantities of Compounds XI, XIV and XV listed above. All other conditions of coating, drying, exposing and processing were carried out as in Exaple V to give the results shown in the following table.

TABLE XI

| Emulsion No. | Additive Variation | Fog | $D_{max}$ |
|---|---|---|---|
| 1 | None-Control | .03 | .08 |
| 2 | 0.10 gram Compound XI | .04 | 1.72 |
| 3 | 0.0865 gram Compound XIV | .04 | 2.11 |
| 4 | 0.0711 gram Compound XV | .06 | 3.63 |

It is evident that the compounds are active silver halide emulsion sensitizers.

EXAMPLE XI

Four emulsions were made as described in Example I except that two emulsions were used as controls one of which contained no sulfur sensitizer. To each of two similar emulsions there was added, per 1.5 moles of silver nitrate, $1.74 \times 10^{-4}$ mole of compound XVI shown above. The emulsions were otherwise treated as in Example I with the sensitometric results shown in the following table.

TABLE XII

| | Coating No. | Fog | $D_{max}$ (Step 20) |
|---|---|---|---|
| 1 | Control - | .03 | 1.08 |
| 2 | $1.74\times10^{-4}$ Compound XVI | .04 | 1.79 |
| 3 | Control - no sulfur sensitizer | .03 | .39 |
| 4 | $1.74\times10^{-4}$ Compound XVI no sulfur sensitizer | .02 | 1.48 |

EXAMPLE XII

Two emulsions were made as described in Example I except that to one emulsion, per 1.5 moles of silver nitrate, there was added 0.03 gram of compound XVII shown above. The emulsions were exposed and processed as described in Example II to give the sensitometric results shown in the following table.

TABLE XIII

| | Coating No. | Fog | $D_{max}$ | Speed (Dens. = 1.5) |
|---|---|---|---|---|
| 1 | Control | .02 | 2.35 | 100 |
| 2 | 0.03 gram of Compound XVII | .04 | 2.24 | 167 |

EXAMPLE XIII

Direct positive silver chlorobromide emulsions were made in a manner similar to Example V up to the point of washing and redispersion. To the potassium chloride solutions used for the initial precipitation, there was added per 1.5 moles of silver nitrate varying amounts of Compound IV above as shown in the following table.

After redispersion, the emulsions were treated similarly to Example V except that per 1.5 moles of silver nitrate there was added $2.4 \times 10^{-6}$ mole of cesium thiaborane as a chemical fogging agent according to the teaching of Bigelow, U.S. Pat. No. 3,637,392.

The emulsions were exposed as described in Example V to give the sensitometric results shown in the table.

TABLE XIV

| Coating No. | Additive Variation Per 1.5 Moles Silver Nitrate | Fog | $D_{max}$ | Speed (Dens. = 1.0) |
|---|---|---|---|---|
| 1 | Control - none | .06 | 1.68 | 100 |
| 2 | 0.03 gram | .05 | 1.64 | 117 |
| 3 | 0.3 gram | .06 | 2.00 | 121 |

The above data indicate that Compound IV, iron chloride cyclen chelate, produces increased sensitivity in a direct positive type silver halide emulsion.

EXAMPLE XIV

Gelatine-silver iodobromide emulsions were made in a manner similar to that described in Example I. The ferric chloride cyclen chelate (Compound IV) was added after the washing and redispersion steps in amounts shown in the following tables. The tables indicate that the iron chloride cyclen chelate functions as a sensitizer over a wide range of quantities and also functions well when used alone or in conjunction with conventional gold and sulfur sensitizers.

The sensitometric results shown in Tables XV (for emulsions containing no gold or sulfur sensitizers) and XVI (for emulsions containing identical amounts of a gold sensitizer) were obtained when the emulsions were exposed in a sensitometer equivalent to 4470 meter-candle-seconds and developed 2 minutes at 68°F. in a conventional metol-hydroquinone developer and fixed, washed and dried.

The sensitometric results shown in Tables XVII (for emulsions containing identical amounts of a sulfur sensitizer) and XVIII (for emulsions containing identical respective amounts of gold and sulfur sensitizer) were obtained when the emulsion were exposed as described in Example I.

TABLE XV (No sulfur or gold sensitizers)

| Coating No. | Additive Variation Per 1.5 Moles $AgNO_3$ | Fog | $D_{max}$ | Speed (Dens.= 1.5) |
|---|---|---|---|---|
| 1 | Control - none of Compound IV | .03 | 3.18 | 100 |
| 2 | $3\times10^{-6}$ mole | .03 | 2.95 | 153 |
| 3 | $6\times10^{-6}$ mole | .03 | 3.15 | 334 |
| 4 | $1.44\times10^{-5}$ mole | .03 | 3.07 | 438 |
| 5 | $3\times10^{-5}$ mole | .03 | 3.14 | 658 |
| 6 | $6\times10^{-5}$ mole | .04 | 2.49 | 578 |

TABLE XVI (Emulsions contained a gold sensitizer)

| Coating No. | Additive Variation Per 1.5 Moles $AgNO_3$ of Compound IV | Fog | $D_{max}$ | Speed (Dens. = 1.5) |
|---|---|---|---|---|
| 1 | Control - none | .03 | 2.85 | 100 |
| 2 | $1.44\times10^{-6}$ mole | .03 | 3.14 | 160 |
| 3 | $3\times10^{-6}$ mole | .16 | 3.09 | 347 |

TABLE XVII (Emulsions contained a sulfur sensitizer)

| Coating No. | Additive Variation per 1.5 Moles Silver Nitrate of Compound IV | Fog | $D_{max}$ | Speed (Dens. = 1.0) |
|---|---|---|---|---|
| 1 | Control - none | .03 | 1.06 | 100 |
| 2 | $1.44\times10^{-6}$ mole | .03 | 1.35 | 165 |

TABLE XVII-continued

| Coating No. | (Emulsions contained a sulfur sensitizer) Additive Variation per 1.5 Moles Silver Nitrate of Compound IV | Fog | $D_{max}$ | Speed (Dens. = 1.0) |
|---|---|---|---|---|
| 3 | $3\times10^{-6}$ mole | .03 | 1.70 | 321 |
| 4 | $6\times10^{-6}$ mole | .03 | 2.23 | 700 |

TABLE XVIII

| Coating No. | (Emulsions contained both gold and sulfur sensitizers) Additive Variation Per 1.5 Mole $AgNO_3$ of Compound IV | Fog | $D_{max}$ | Speed (Dens. = 1.0) |
|---|---|---|---|---|
| 1 | Control - none | 0.3 | 1.36 | 100 |
| 2 | $3\times10^{-9}$ mole | .03 | 1.52 | 157 |
| 3 | $4\times10^{-9}$ mole | .03 | 1.54 | 187 |
| 4 | $3\times10^{-8}$ mole | .04 | 1.94 | 396 |
| 5 | $3\times10^{-7}$ mole | .04 | 2.03 | 736 |

As indicated by the various examples the novel sensitizers of this invention may be used as the sole sensitizer in the silver halide system or they may be used in conjunction with other known sensitizers, i.e., sulfur compounds and gold compounds. There also may be used reducing agents, e.g., stannous salts, compounds which sensitize by development acceleration, e.g., polyoxyalkylene compounds and the polyhedral boranes disclosed in Bigelow U.S. Ser. No. 197,166 filed Nov. 9, 1971 now in allowance and Bigelow, U.S. Pat. No. 3,761,275. In addition, optical sensitizing dyes can be used in the silver halide systems having the novel macrocyclic polyamine sensitizers of this invention.

Silver halide emulsions sensitized according to this invention can also contain conventional additions such as plasticizers for the colloid carrier in which the silver halide crystals are dispersed, antifoggants such as thiazoles, triazoles, tetraazaindenes and the like. Various silver salts in addition to those used in the Examples may be used, e.g., silver bromide, silver iodochlorobromide, etc.

The silver halide emulsions of this invention cam be made with any of the macromolecular, water-permeable colloids known to be suitable for the purpose of acting as a colloid carrier for silver halide grains. Besides gelatin, there may be used polyvinyl alcohol and its derivatives, e.g., partially hydrolyzed polyvinyl acetates, ethers and acetals, hydrolyzed interpolymers of vinyl acetate and unsaturated addition compounds such as maleic anhydride, acrylic and methacrylic acid esters, poly-N-vinyllactams, polysaccharides, e.g., dextran, dextrin, etc., the hydrophilic copolymers disclosed in Shacklett U.S. Pat. No. 2,833,650, hydrophilic cellulose ethers and esters, and acylamide polymers, mixtures of these binders can also be used as well as water-permeable binding agents containing dispersed polymerized vinyl compounds such as those disclosed in Nottorf, U.S. Pat. No. 3,142,568 issued July 28, 1964.

The emulsions of this invention may be coated on any suitable support including photographic quality paper and transparent film. For example cellulose supports, e.g., cellulose acetate, cellulose triacetate, cellulose mixed ester, etc., may be used. Polymerized vinyl compounds, e.g., copolymerized vinyl acetate and vinyl chloride, polystyrene and polymerized acrylates may also be mentioned. The film formed from the polyesters made according to the teachings of Alles, U.S. Pat. No. 2,779,684 and the patents referred to in the specification of that patent. Other suitable supports are the polyethylene terephthalate/isophthalates of British Pat. No. 766,290 and Canadian Pat. No. 562,672 and those obtainable by condensing terephthalic acid and dimethyl terephthalate with propylene glycol, diethylene glycol, tetramethylene glycol or cyclohexane-1,4-dimethanol (hexahydro-p-xylene alcohol). The films of Bauer et al, U.S. Pat. No. 3,059,543 may also be used. The above polyester films are particularly suitable because of their dimensional stability.

Many macrocyclic polyamines of the formula of the invention other than those illustrated above can be used as chemical sensitizing agents for the silver halide emulsions of this invention.

I claim:

1. A photographic colloid-silver halide emulsion containing a sensitizing amount of a chemical sensitizer or a salt or metal chelate thereof, said chemical sensitizer having the formula $$\left[(NH-(CH_2)_n)_m\right]$$

where $m$ is 4–7 and each $n$ is independently 2–5.

2. An emulsion according to claim 1 wherein said chemical sensitizer or salt or metal chelate thereof has the formula 1,4,7,10-tetraazacyclododecane.

3. An emulsion according to claim 1 wherein said chemical sensitizer or salt or metal chelate thereof has the formula copper II chloride 1,4,7,10-tetraazacyclododedane chelate.

4. An emulsion according to claim 1 wherein said chemical sensitizer or salt or metal chelate thereof has the formula nickel II chloride 1,4,7,10-tetraazacyclododecane chelate.

5. An emulsion according to claim 1 wherein said chemical sensitizer or salt or metal chelate thereof has the formula iron III chloride 1,4,7,10-tetraazacyclododecane chelate.

6. An emulsion according to claim 1 wherein said chemical sensitizer or salt or metal chelate thereof has the formula thallium III nitrate 1,4,7,10-tetraazacyclododecane chelate.

7. An emulsion according to claim 1 wherein said chemical sensitizer or salt or metal chelate thereof has the formula rhodium III chloride 1,4,7,10-tetraazacyclododecane chelate.

8. An emulsion according to claim 1 wherein said chemical sensitizer or salt or metal chelate thereof has the formula 1,4,7,10-tetraazacyclododecane tetrahydrochloride.

9. An emulsion according to claim 1 wherein said chemical sensitizer or salt or metal chelate thereof has the formula isocyclam tetrahydrochloride.

10. An emulsion according to claim 1 wherein said chemical sensitizer or salt or metal chelate thereof has the formula 1,4,8,11-tetraazacyclotetradecane tetrahydrochloride.

11. An emulsion according to claim 1 wherein said chemical sensitizer or salt or metal chelate thereof has the formula 1,4,7,10,13-pentaazacyclopentadecane pentahydrochloride.

12. An emulsion according to claim 1 wherein said chemical sensitizer or salt or metal chelate thereof has the formula 1,4,7,10,16-hexaazacyclooctadecane trisulfuric acid.

13. An emulsion according to claim 1 wherein said chemical sensitizer or salt or metal chelate thereof has the formula 1,4,9,12,15,20-hexaazacyclodocosane hexahydrochloride.

14. An emulsion according to claim 1 wherein said chemical sensitizer or salt or metal chelate thereof has the formula 1,4,7,13,16,19-hexaazacyclotetracosane hexahydrochloride.

15. An emulsion according to claim 1 wherein said chemical sensitizer or salt or metal chelate thereof has the formula 1,4,7,10,13,16-hexaazacyclooctadecane hexahydrochloride.

16. An emulsion according to claim 1 wherein said chemical sensitizer or salt or metal chelate thereof has the formula 1,4,7,10,13,16-hexaazacyclooctadecane copper chloride chelate.

17. An emulsion according to claim 1 wherein said chemical sensitizer or salt or metal chelate thereof has the formula 1,4,7,10-tetraazacyclotridecane tetradihydrosulfate.

18. An emulsion according to claim 1 wherein said chemical sensitizer or salt or metal chelate thereof has the formula 1,4,7,10,13,16,19-heptaazacycloheneicosane heptahydrochloride.

19. An emulsion according to claim 1 wherein the metal of the metal chelate is selected from the groups I*b*, III*a*, and VIII of the Periodic Table.

20. An emulsion according to claim 19 wherein said metal is selected from iron, nickel, copper, rhodium and thallium.

21. A photographic element comprising a support bearing at least one layer of an emulsion of claim 1.

* * * * *